US006498326B1

(12) United States Patent
Knappe

(10) Patent No.: US 6,498,326 B1
(45) Date of Patent: Dec. 24, 2002

(54) ARRANGEMENT FOR THE CONTROL OF ELECTRICALLY CONTROLLABLE APPLIANCES, PARTICULARLY ELECTRIC COOKERS

(75) Inventor: Gerd Knappe, Bretten (DE)

(73) Assignee: E.G.O. Elektro-Geratebau GmbH (DE)

( * ) Notice: Subject to any disclaimer, the term of this patent is extended or adjusted under 35 U.S.C. 154(b) by 0 days.

(21) Appl. No.: 09/467,657

(22) Filed: Dec. 20, 1999

(30) Foreign Application Priority Data

Dec. 21, 1998 (DE) ..... 198 59 105

(51) Int. Cl.[7] ..... H05B 6/12

(52) U.S. Cl. ..... 219/625; 219/620; 219/507; 307/104

(58) Field of Search ..... 219/620, 622, 219/625, 445.1, 457.1, 507, 509, 515; 200/547–550, 16 R; 335/284, 205; 307/104; 338/200

(56) References Cited

U.S. PATENT DOCUMENTS

| | | | | |
|---|---|---|---|---|
| 3,711,672 A | | 1/1973 | Moreland, II et al. | |
| 3,852,558 A | | 12/1974 | McCleerey et al. | |
| 4,317,016 A | * | 2/1982 | Ito | 219/622 |
| 4,812,804 A | * | 3/1989 | Masaki | 338/200 |
| 4,983,812 A | * | 1/1991 | Worrall et al. | 219/445.1 |
| 5,920,131 A | * | 7/1999 | Platt et al. | 307/104 |

FOREIGN PATENT DOCUMENTS

| | | |
|---|---|---|
| DE | 3302959 A1 | 8/1984 |
| DE | 39 22 071 | 1/1991 |
| DE | 19612422 A1 | 10/1997 |
| EP | 0 497 191 | 8/1992 |
| EP | 0 797 227 | 3/1997 |
| WO | WO 89/04543 | 5/1989 |

* cited by examiner

*Primary Examiner*—Teresa Walberg
*Assistant Examiner*—Quang Van
(74) *Attorney, Agent, or Firm*—Akerman Senterfitt

(57) ABSTRACT

An arrangement for controlling electrically controllable appliances, such as electric cookers, has at least one manually operable control element placed on an outside of a plate, e.g. a glass ceramic plate of an electric cooker, which is secured by a magnetic holding device in non-contacting magnetic manner on the plate. A sensor device determines the position and/or position change of the control element and an associated control device, in order to set different operating modes of the appliance. The control element is constructed as a sliding key automatically returning to a rest position and which is displaceable in at least one displacement direction along the plate. Such sliding keys can be operated in a particularly easy manner and are well adapted to an at least partial digital processing of the sensor signals to controlling signals.

29 Claims, 1 Drawing Sheet

Figure 1:
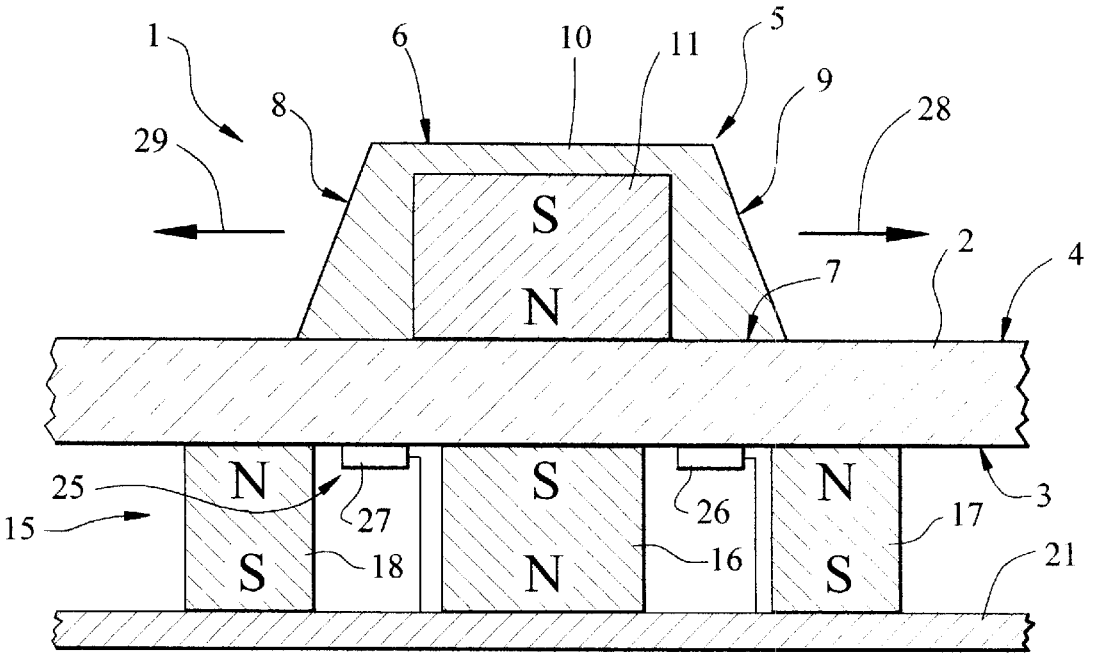

ARRANGEMENT FOR THE CONTROL OF ELECTRICALLY CONTROLLABLE APPLIANCES, PARTICULARLY ELECTRIC COOKERS

The invention relates to an arrangement for the control of electrically controllable appliances, particularly electric cookers.

The preferred field of application for the invention is the control of electrically operated domestic appliances, particularly electric cookers, e.g. those having a glass ceramic cooking area and/or an electric oven. Such control arrangements have at least one manually operable control or control element placeable or placed on an outside of a plate of the appliance and which is held on or close to the plate by an associated holding device. There is also a sensor device intended to cooperate with a control device of the appliance for determining the position and/or position change of the control element. By appropriately moving the control element a desired switching state can be set.

A known and very frequently used construction of such control elements or controls is constituted by knobs. Knobs can be placed individually or in a group on a front panel of a cooker or the like below the normal working level. As a result of this arrangement the scales on such knobs are sometimes difficult to read. There is also a risk of the knobs being reached and operated by small children. Keeping clean can also constitute a problem. A large amount of space is generally required for the fitting of the knobs with corresponding mechanical holding devices.

These problems can be partly removed by the placing of the knobs on the top of the appliance. EP 797 227 shows for this purpose a construction particularly suitable for fitting to glass ceramic plates, in which the knobs are secured magnetically through the plate by means of a holding magnet placed on the underside of the glass ceramic plate. Knobs must have a certain minimum height, so that they can be easily turned and gripped by hand. Thus, they can interfere with the handling of cooking utensils in the cooking area. In addition, a free hand is necessary for their operation, so as to be able to securely hold and turn the knob.

Another known class of control elements is constituted by sliders, which are used for setting a desired operating state starting from a usually stop-limited, fixed neutral position can be slid over a clearly defined sliding or displacement path into an end position corresponding to the desired switching state. Examples of such sliders are described in European patent application EP 497 191 and U.S. Pat. Nos. 3,711,672 and 3,852,558. The precise setting of a desired end position can be problematical, because an energetic operator can slide it beyond the end position and a subsequent correction can be necessary. Moreover, both with the known knobs and also the sliders, on the way to the desired end position it is necessary to pass through all the intermediate positions and at least briefly switching states associated therewith may be assumed or activated.

The problem of the invention is to provide an arrangement for the control of electrically controllable appliances which, in the case of easy operation, permits a reliable setting of a desired switching state.

According to the invention this problem is solved by an arrangement having the features of claim 1. Further developments of the invention are given in the subclaims, whose wording is made by reference into part of the description.

An inventive control arrangement is characterized in that at least one control element is constructed as a slider automatically returning to an off or rest position and which is slidable along the plate in at least one sliding direction. Such a slider or sliding key creates the possibility of using a sliding process as such as a switching event, without it being a question of the precise maintaining of a sliding path corresponding to this state e.g. for setting a desired switching state. A self-resetting slider must, unlike in the case of conventional knobs or path sliders, not necessarily be gripped and moved by the fingers of a hand for its operation, but can instead be operated e.g. with the elbow, forearm or back of a hand. This facilitates operation, particularly if e.g. both hands are needed for holding a saucepan or the like. An inventive sliding key is also particularly advantageously adapted to a digital processing of sensor signals or control signals, because a controlling adjusting process with subsequent return to the rest position can be treated as an event e.g. detectable by a digital counter. There is no need to use analog/digital converters, which must be used with conventional knobs or sliders for generating digitally processable signals.

Certain advantages of the invention are usable with sliding keys controlling slidable in only one sliding direction. According to a preferred further development the control element can be slid in controlling manner in at least two different sliding directions, starting from the rest position, for generating at least two different control signals. Thus, the number of settings possible with a single control element is advantageously increased, because the sliding direction can now be used as a further input parameter for control purposes. Although the individual sliding directions can be oriented in random, optionally very small planar angles parallel to the plate surface, it is preferable if there are at least two antiparallel switching displacement directions, so that it is possible to implement a uniaxial, bidirectional sliding key. Multiaxial displaceable sliders are also possible. Thus, in an embodiment and starting from a common rest position, four controlling displacement directions oriented at right angles to one another are provided, so that a biaxial, bidirectional sliding key can be obtained. Sliding or displacement directions can also be arranged in a radial or fan-like manner and it is appropriately ensured that displacement directions in the plane are far enough apart in order to prevent an accidental setting by the user of an undesired switching state. A key displaceable in several, preferably coplanar displacement directions inter alia permits the selection of switching targets via the choice of the displacement direction. A direct switching e.g. between different operating modes of an oven is possible, without it being necessary on the switching path to also switch in at least briefly undesired modes. This protects both the heating-active components and also the control components and avoids in the case of switching processes for higher electric currents difficultly avoidable repercussions of the switching on the main supply.

The use of a sliding event for the control of the appliance can take place in different advantageous ways as a function of the particular circumstances. Thus, for reasons of operational safety and to avoid incorrect actuations, it is advantageous for the sensor device to be coupled or cooperate with the control device in such a way that a controlling displacement only occurs on exceeding a minimum displacement range in the particular displacement direction. This creates a lower threshold for a controlling displacement, so that in the case of an unintentional small movement of the actuating element and/or with a movement in a direction diverging from an intended displacement direction no control effect occurs. This ensures that only desired, targeted displacements give rise to a control effect.

According to a further development, the sensor device is so coupled with the control device that in the case of a controlling displacement on exceeding a minimum displacement range a single control signal is generated and preferably in certain limits independently of the displacement range achieved with maximum deflection from the rest position. Thus, an on/off information can be associated with the particular displacement direction which can be particularly easily digitally processed. Thus, e.g. with a particular displacement or sliding direction can be associated a specific oven function (hot air, grill, bottom heat, top heat, top and bottom heat, circulating air, etc.), which can in each case be associated by means of the keying or sliding process in the associated displacement direction. In a cooking area circuit it is e.g. possible to preselect a particular parboiling stage, e.g. with 60 or 80% of the rated power.

It is also possible for the coupling to be designed in such a way that with a controlling displacement a number of control signals is generated as a function of a holding time in the displaced or deflected state. Such a time-dependent control can e.g. be used for the stepwise passage through menu points of a presettable control menu or for the stepwise setting of temperature values or for operating mode selection in a preset sequence.

It is also possible to design the control in such a way that a control signal is generated as a function of the number of successive, controlling displacements in a preset displacement direction. Thus, by means of multiple displacements a user can set a desired control state and appropriately the number of displacements or keying processes is counted and a further keying process only increases the same if this takes place briefly within a presettable time limit following a preceding keying process.

The switching state reached can be rendered easily detectable for the user, e.g. by an optical display and/or acoustically.

Any suitable holding device can be used for maintaining the control element on the plate, particularly one having positively and/or nonpositively acting mechanical holders and/or guides. In order to avoid such elements, particularly on the outside of the plate, in a preferred embodiment the holding device is located on the inside of the plate opposite to the control element, so that it cannot cause interference on the operation side. Preferably the holding device is constructed as a device for producing a preferably magnetic field of force, which acts on the control element in non-contacting manner, particularly through the plate and maintains the same on or in the vicinity of the plate. Preferably a control element is held on the plate exclusively by the force of the field of force, so that no further holding devices are required. The control element can be held in an exclusively non-contact manner in the vicinity of the point where it is to be operated and for e.g. cleaning purposes and without the aid of tools can be removed from the plate. The plate, e.g. a glass ceramic plate, preferably has no openings, passages, depressions, mounting supports, etc., which could act as dirt traps or through which dirt could penetrate into the vicinity of the inside of the plate. The plate can be made from a material such that the force field lines pass in substantially unattenuated manner through it. The control element can e.g. engage on the outside, i.e. the top or front of the plate and a special design of the directly engaging part can contribute to a low-friction or friction-free movement. For this purpose e.g. a mounting on rolls and/or balls can be provided, which can e.g. be fitted to the underside of the actuating element. The term non-contacting mounting of the control element means that the latter can be held without any direct mechanical connection, but it can naturally contact the plate.

Although the restoring or resetting function according to the invention can also be achieved by mechanical means, such as e.g. return springs and the like, it is preferably also brought about in contactless manner. For this purpose the holding device can have at least one, preferably fixed holding magnet and the control element at least one equidirectionally polled magnet. Then e.g. a north pole of the holding magnet facing the plate and a south pole of the magnet facing the plate and the holding magnet can face one another on or in the control element and by means of the relative position with minimum possible, mutual spacing of the magnets define the rest position, in which opposite poles on the holding magnet and control element magnet face one another. The interplay of suitably polled magnets, particularly permanent magnets, on either side of the plate compared with an also possible arrangement with one magnet on one side of the plate and a magnetizable, e.g. ferromagnetic material on the other side, the advantage of a particularly sharp energy minimum of the magnetic field in the minimum spacing area, so that the rest position is particularly reliably and precisely set, even if e.g. frictional forces act against an exact setting.

A particularly secure and energetic holding of the control element and restoring to the rest position is achieved in a preferred development in that the holding device has an inner magnet arrangement with at least one plate-facing, inner magnetic pole and with radial, plate-parallel spacing thereto an outer magnet arrangement of opposite polarity. Through the location of the inner magnet arrangement it is possible to define the rest position of the control element, whilst the outer magnet arrangement substantially assist the guidance and restoring of the slider. Through the opposite polarity of inner and outer magnet arrangements it is possible to ensure that to an attraction towards the rest position brought about by the inner magnet arrangement is added a repulsion of the actuating element towards the rest position brought about by the outer magnet arrangement, so that particularly strong restoring forces are provided. For example, the outer magnet arrangement can be arranged in ring-like and/or rectangular manner around the inner magnet arrangement. A suitable magnetic guidance for the described uniaxial or biaxial, bidirectional slide arrangements can be obtained in that the holding device is constructed for producing a multifold, rotationally symmetrical field of force, particularly a magnetic field and preferably the field of force has a two or four-fold rotational symmetry with the rotation axis perpendicular to the plate.

According to a further development of the invention, the sensor device has at least one sensor on the inside of the plate and which responds to a change to a field, particularly a magnetic, electromagnetic or electric field brought about through an operation of the control element. A sensor can e.g. operate in capacitive, optical or inductive manner. Preferably the sensor device has at least one magnetic field, sensitive sensor, which is placed or is placeable in the working range of a magnet of the control element. It can be a reed contact or switch or a coil. Preferably use is made of Hall sensors, which due to the lack of movable parts operate permanently in a reliable manner and whose output signals in the form of d.c. voltages can be particularly easily and reliably processed. The sensor can be influenced by the same physical phenomenon used for securing the control element, particularly by a magnetic field. Then individual components, such as e.g. a magnet of the control element, can fulfil a double function both in the holding means and also in the sensor device. Embodiments are particularly cost-effective and well adapted to the character of a sliding key in which for each displacement or sliding direction a single sensor is provided, whose output signal indicates a controlling displacement.

According to a further development of the invention, the sensor device has at least two sensors constructed for emitting sensor signals and the control device has at least one logical interconnection unit for the logical interconnection of sensor signals or signals derived from the sensor signals. This makes it possible with relatively few, e.g. only two sensors to set a number of different switching states extending beyond the number of sensors and which result from the states of the individual sensors through logical interconnections, e.g. using the rules Boolean algebra. The sensor device can e.g. cooperate with the control device in such a way that on removing the control element from the plate the appliance is switched into a stable off-state. This creates a manually operable, electromechanical on-off switch, which in particular provides security against unauthorized use, particularly by playing children. The situation can also be such that the sensor device cooperates with the control device in such a way that when the control element is in the rest position the appliance is switched into a readiness state differing from the off state. This standby function can encourage a faster putting into operation should this be necessary, because in the standby function certain fundamental functions can be activated.

These and further features can be gathered from the claims, description and drawings and the individual features, both singly and in the form of subcombinations, can be implemented in an embodiment of the invention and in other fields and can represent advantageous, independently protectable constructions for which protection is hereby claimed.

An embodiment of the invention is described in greater detail hereinafter relative to the attached drawings,. wherein show:

FIG. 1 A diagrammatic vertical section through an embodiment of an inventive control arrangement, which is fitted to a glass ceramic plate of a cooker having a glass ceramic cooking area.

Figure 2:
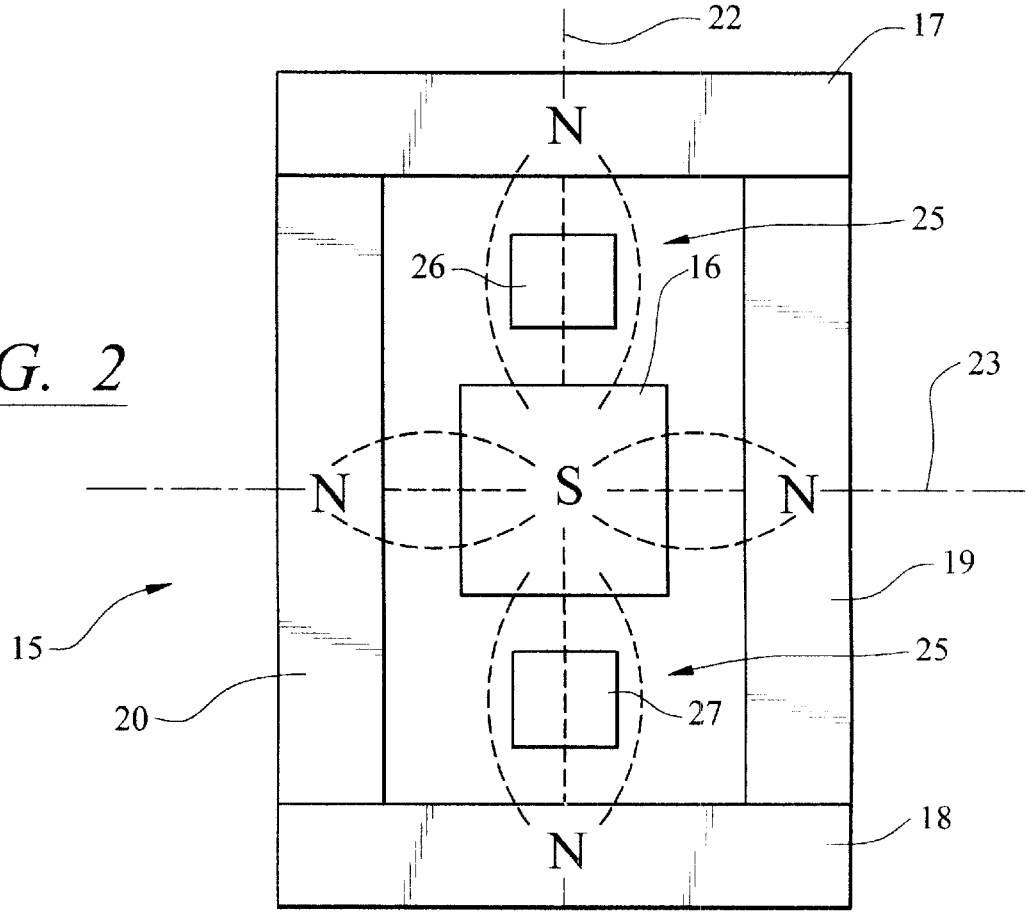

FIG. 2 A diagrammatic plan view of the control arrangement devices of FIG. 1 placed below the glass ceramic plate.

The diagrammatic vertical section of FIG. 1 shows a control arrangement 1 for the control of an electric cooker, whose top or working surface is defined by a horizontal glass ceramic plate 2, which can have one or more spaced cooking points. The heating means more particularly constructed as radiant heaters for the individual cooking points are placed on the inside or underside 3 of the plate and emit their heat radiation through the plate to the outside or top 4 thereof on which the cooking utensils can be placed. On the top of the throughout planar and constantly thick plate surrounded by a separate frame are provided in a row adjacent and/or juxtaposed, several manually operable control elements with which the individual heating means can be manually controlled independently of one another, e.g. switched on and off, as well as being settable to different outputs. The crosssectionally represented control element 5 is one of e.g. four to ten control elements arranged in a row directly adjacent to one another and parallel to the outer edge between the cooking areas and an outer edge of the plate.

The control element 5 is in the form of a square pyramidal frustum and compared with standard knobs is very flat or shallow and has a height of roughly twice the thickness of the glass ceramic plate 2. The planar, square top 6 and its parallel, square, planar bottom 7, which rests in full surface manner on the plate top 4, are connected by means of lateral inclined surfaces 8, 9, whose outsides have a good grip profiling, e.g. can be ribbed or studded. The very simply constructed control element 5 essentially comprises two parts, namely a plastic body 10 having a bottom rectangular recess and a parallelepipedic permanent magnet 11 inserted in close-fitting manner in the rectangular recess and which terminates flush with the bottom 7 of the body 10. The plate top 4 is free from projections or depressions, which could bring about a mechanical guidance or movement limitation parallel to the plate surface of the freely displaceable control element 5. The magnet 11 is oriented in such a way that its magnetic north pole faces the bottom 7 or, when the actuating element is fitted, the plate 2 and its internal magnetic field leading to the south pole is oriented substantially perpendicular to the bottom 7 or plate 2. It can be a permanent magnet with a high coercive field strength, e.g. an iron-neodymium-boron permanent magnet.

In a space below the glass ceramic plate 2 hermetically sealed by the latter and further, not shown parts is provided a holding device 15 with several, in each case parallelepipedic permanent magnets 16 to 20 engaging directly on the underside or bottom 3 of the plate and which is readily visible in FIG. 2. Said permanent magnets produce a permanent magnetic field of force or magnetic field, which is sufficiently strong to ensure that the top engaging slider 5 in the case of lateral pressure on the inclined surfaces 8 or 9 can be displaced relatively easily and in limited manner parallel to the plate surface, but a raising of the control element from the plate surface for overcoming the magnetic attraction forces between the holding device 15 and control element 5 requires a deliberate exerting of force on the part of a user.

FIG. 2 shows that the holding device 15 has a first or inner magnet arrangement formed by the parallelepipedic magnet 16 and whose polarity when the control element is fitted is oriented equidirectionally with the polarity of the control element magnet 11, so that over and beyond the plate the north pole of the control element magnet 11 and the south pole of the central holding magnet 16 face one another with a minimum spacing corresponding to the plate thickness, so that there is a high holding force in the central area. Around the central magnet 16 is arranged an outer, second magnet arrangement in the form of a rectangular ring completely surrounding the inner magnet 16 and which is constituted by four identical, directly abutting, parallelepipedic permanent magnets 17 to 20. The magnets 16 to 20 of the holding device are fixed to the top of a printed circuit board 21, which during the fitting of the device is so fixed below the glass ceramic plate that the magnets are pressed flat with their planar tops onto the plate bottom 3.

From the central magnet 16 the outer magnets have a plate-parallel, radial spacing of roughly the plate thickness or a few millimeters to a few centimeters and the outer magnets have an opposite polarity to the inner magnet 16 and their north poles are directed towards the plate bottom 3. The magnet arrangement of the holding device 15 mirror symmetrical to the central longitudinal axis 22 and the central transverse axis 23 produces a two-fold rotationally symmetrical magnetic field characterized by the field lines indicated in broken line form with respect to a rotation axis perpendicular to the plate 2 and having two perpendicular superimposed preferred directions defined by mirror planes between the inner south pole and an outer north pole.

In the embodiment shown for determining the position and/or a position change of the control element 5 there is a sensor device 25 with two Hall sensors 26, 27, which are connected to an evaluating and control circuit carried by the printed circuit board 21 and in the fitted state are in the immediate vicinity of the bottom 3 of the glass ceramic plate. The magnetic field-sensitive Hall sensors 26, 27 are in each case placed on the central longitudinal or mirror axis 22 of the holding device 15 roughly centrally between the central holding magnet 16 and the narrow-side outer magnets 17 or 18 and are consequently located in an area only slightly penetrated-in parallel manner to the surface extension of the Hall sensor by the magnetic field of the holding device. They are located in the working range of the magnetic field produced by the control element magnet 11 and which penetrates in inclined manner the area of the Hall sensors and in the central or rest position of the control element 5 shown in FIG. 1 is substantially of the same intensity at the location of both Hall sensors 26, 27.

The centrally positioned, square magnet 16 essentially exerts a holding and centring function in non-contacting manner through the plate 2 onto the magnet 11 of the control element 5, through which the slider 5 in the absence of external sliding forces is held in the central or rest position shown in FIG. 1. The further rectangular magnets 17 to 20 arranged around the central magnet 16 assist the centring function, in that the plate-facing north poles act in centring pairwise symmetrical repelling manner on the north pole of the control element magnet 11. The magnets of the outer magnet arrangement also bring about a non-contacting, magnetic guidance of the control element 5 and its automatic resetting after releasing the button and the restoring force also passes magnetically in non-contacting manner through the magnetically permeable plate 2. On sliding the slider 5 restoring forces occur in all four displacement directions perpendicular on the lateral edges of the outer magnet arrangement. Since, however, the outer magnets 19, 20 located on the longer sides are much closer to the central magnet 16 than the magnets 17, 18 on the shorter sides, the restoring force in the displacement direction perpendicular to the longer mirror plane 22 is much greater than parallel to the mirror plane 22. The elongated rectangular arrangement parallel to this direction consequently creates a magnetic guidance trough or groove, in which starting from the rest position over the central magnet 16 displacements are relatively easily possible parallel to the longer mirror axis 22, i.e. towards the Hall sensors 26, 27, whereas displacements at right angles to this direction are magnetically strongly counteracted.

The magnetic holding device 25 consequently not only fulfils a holding function, which secures the control element 5 against unintentional lifting or falling and secures same on the plate top, but also fulfils the function of a lateral guide only allowing a displacement in two antiparallel directions 28 and 29 parallel to the plane 22. In addition, there is an automatic resetting to the central rest position. With the two Hall sensors 26, 27 it is possible to determine the displacement movement of the slider 5 in the displacement direction 28 or the antiparallel displacement direction 29 thereto.

If the slider 5 is e.g. slid in direction 28, then both Hall sensors will detect a change to the magnetic field strength, which increases in the vicinity of sensor 26 and decreases in the vicinity of sensor 27. The magnetic field changes, which primarily act as changes to the Hall voltage applied, can be converted into electric pulses by the connected control device and converted into switching pulses by following electronics. The Hall sensors preferably supply the digital output signals, so that e.g. a Hall voltage above a presettable voltage value coresponds to a logic high level, whereas a dropping below the threshold corresponds to a logic low level. The corresponding levels or signals can be supplied to a logical interconnection unit of the control device, which derives associated switching signals from the magnetic conditions prevailing in the vicinity of the sensors 26, 27. Construction can be such that with the slider 5 fitted, in its rest position both sensors 26, 27 supply as a result of the substantially identical magnetic field strength a logic high level from which the interconnection logics conclude that there is an operating button in the rest position and the electrical appliance is thereby switched into a standby or readiness state in which fundamental functions are activated. By sliding the slider or sliding key 5 e.g. in sliding direction 28 the magnetic flux in the vicinity of the Hall sensor 27 no longer or only slightly influenced by the magnet 11 is so small that it drops out and supplies a logic low level. The connected interconnection unit derives from the input values of the two sensors 26, 27 a switching signal associated with the sliding in sliding direction 28 by means of which e.g. a particular parboiling capacity of the associated cooking area is set. If the sliding key 5 is slid so far in sliding direction 28 that the control element magnet 11 is moved away from the central magnet 16 and approaches the outer magnet 17, then the magnetic attraction forces of the central magnet in interplay with the repulsion forces of the outer magnet 17 acting in the same direction bring about a sliding resistance which is clearly perceptible for the user and which indicates the end of the sliding or keying process. If a user then releases the slider, in order to minimize the magnetic field energy it is automatically reset to the rest position shown in FIG. 1. A corresponding sliding or keying process can be performed in the opposite sliding direction 29 and the resulting high level on the Hall sensor 27 in conjunction with the low level at Hall sensor 26 brings about a switching function associated with sliding direction 29. If there is no slider on the system, because it has e.g. been removed from the plate to provide security against unauthorized use, then as a result of the low magnetic field strength both Hall sensors 26, 27 supply a logic low level. From this the interconnection logic can bring about a control signal for a stable off state, which is generally set through the removal of the control element.

It is clear that only a single sensor is needed for each sliding or displacement direction, in order with the two displacement directions to choose in all four different states by a suitable operation of the sliding key 5, namely the associated functions for the sliding directions and a standby function associated with the rest position and the off function associated with the absence of the control element.

It is clear to an expert that a uniaxial, bidirectional sliding key through the appropriate arrangement of further sensors, which can e.g. be located between the central magnet 16 and the long lateral magnets 19, 20 on the short mirror plane 23 of the arrangement 15, can bring about an extension to a biaxial, bidirectional sliding key in the manner of a joystick. Alternatively or additionally to the Hall sensors it is also possible to provide other magnetic field-sensitive sensors such as reed contacts, coils, etc. It is also possible to have nonmagnetic sensors, e.g. capacitively or inductively operating sensors.

As a function of the design of the control device numerous appropriate switching possibilities, which can be used when necessary, can be attained through such sliding keys. Thus, in the described embodiment the magnetic field strengths, sensors and appropriate thresholds in the evaluation electronics are so adapted that in the case of a controlling displacement in one of the displacement directions 28, 29 on exceeding a lower threshold a single control signal is generated, independently of the actual displacement range. Through an evaluation electronics with a timer and a counter it is also possible with a controlling displacement to determine the holding duration in the deflected state and to generate a corresponding control signal as a function thereof. It is e.g. possible to associate with one displacement direction an upward counting and with the opposite direction a downward counting. Counting pulses can be optically and/or acoustically indicated, so as to indicate to a user that the desired switching function has been attained. It is also possible to design the circuit in such a way that a desired control signal or a switching state corresponding thereto is brought about by a presettable number of discreet, controlling displacements, so that e.g. the grill function of an oven can be set by means of a specific number, e.g. three briefly succeeding displacements. The invention fundamentally makes it possible for a control signal to be generated as a function of a displacement range of the control element. For this purpose it would be possible to provide along a displacement direction several sensors, which with increasing displacement range are gradually detected in controlling manner by the magnetic field of the slider 5.

Sliding or pulse keys of the indicated type can be used in the area of electric cookers e.g. for a preferably stepwise setting of temperature values and/or for operating mode selection in oven controls. In the case of a hot point control it is e.g. also possible to preselect a power stage or a freely selectable heating up/parboiling time. With a biaxial key e.g. a second setting can take place via one axis and a temperature setting via another axis. The invention is also not restricted to use in cookers with glass ceramic plates. Thus, non-contacting secured actuating elements can be magnetically held on random, magnetically non-active, horizontal, vertical or sloping casing or housing walls of an appliance.

What is claimed is:

1. Arrangement for controlling an electrically controllable appliance, the arrangement comprising:

at least one control element adapted for arrangement on an outside of a plate of said appliance;

a holding device associated with said control element for holding said control element on said plate; and a sensor device adapted for cooperation with a control device of said appliance, said sensor device being adapted to determine at least one of a position and a position change of said control element, wherein at least one of said control elements is constructed as a self-resetting slider having a rest position and automatically returning to said rest position, and wherein said control element is adapted to be displaceable in at least one displacement direction along said plate and wherein a resetting function of said self-resetting slider is brought about in contactless manner.

2. Arrangement according to claim 1, wherein the control element is adapted to be displaceable in at least two different displacement directions with respect to the rest position for generating at least two different control signals.

3. Arrangement according to claim 2, wherein the control element is displaceable in at least one of two antiparallel displacement directions and four displacement directions oriented at right angles with respect to each other.

4. Arrangement according to claim 1, wherein the sensor device is adapted to cooperate with the control device such that a control signal is generated only when a minimum displacement range in the displacement direction is exceeded.

5. Arrangement according to claim 1, wherein the sensor device is adapted to cooperate with the control device such that upon displacement of said control element a single control signal is generated independently of a displacement range of the control element.

6. Arrangement according to claim 1, wherein the sensor device is adapted to cooperate with the control device in such a way that in the case of a control effective displacement a plurality of control signals can be generated as a function of a holding period of time of the control element in a displaced state.

7. Arrangement according to claim 1, wherein the sensor device is adapted to cooperate with the control device in such a way that a control signal can be generated as a function of a number of briefly succeeding control effective displacements in one displacement direction of the control element.

8. Arrangement according to claim 1, wherein the sensor device is adapted to cooperate with the control device in such a way that the appliance is switched into a stable off state upon removal of the control element from the plate.

9. Arrangement according to claim 1, wherein the sensor device is adapted to cooperate with the control device in such a way that when the control element is positioned in the rest position the appliance is switched into a standby state differing from an off state of the appliance.

10. Arrangement according to claim 1, wherein the sensor device incorporates at least two sensors constructed for emitting sensor signals and wherein the control device comprises at least one logical interconnection unit for the logical interconnection of the at least two sensor signals or of signals derived from the at least two sensor signals.

11. Arrangement according to claim 1, wherein the sensor device comprises at least one sensor located on the inside of the plate, the sensor being responsive to a change of a remote effective field acting through the plate, the field being brought about by an actuation of the control element.

12. Arrangement according to claim 11, wherein the remote effective field is a magnetic field.

13. Arrangement according to claim 1, wherein the sensor device comprises at least one sensor being sensitive to magnetic fields.

14. Arrangement according to claim 13, wherein the control element comprises at least one magnet and wherein the sensor being sensitive to magnetic fields is adapted to be placed in a working range of that magnet.

15. Arrangement according to claim 1, wherein the sensor device comprises only one sensor for each displacement direction of the control element.

16. Arrangement according to claim 1, wherein the holding device is positioned on the inside of the plate opposite to the control element.

17. Arrangement according to claim 1, wherein the holding device is constructed as a device for producing a field of force which acts in non-contacting manner on the control element.

18. Arrangement according to claim 17, wherein the holding device is adapted to produce a magnetic field of force.

19. Arrangement according to claim 17, wherein the control element is held on the plate exclusively by the force of the field of force provided by the holding device.

20. Arrangement according to claim 1, wherein the control element is removable from the plate without the aid of tools.

21. Arrangement according to claim 1, wherein the holding device comprises at least one holding magnet and wherein the control element comprises at least one magnet place able in a working range of the holding magnet.

22. Arrangement according to claim 1, wherein the holding device is constructed for producing a multi-fold, rotationally symmetrical magnetic field.

23. Arrangement according to claim 22, wherein the holding device is constructed for producing a magnetic field comprising at least one of a two-fold rotational symmetry and a four-fold rotational symmetry.

24. Arrangement according to claim 1, wherein the holding device comprises a first magnet arrangement with a magnetic pole facing the plate and, spaced apart from the first magnet arrangement, a second magnet arrangement comprising opposite polarity.

25. Arrangement according to claim 24, wherein the second magnet arrangement comprises one of a ring-like arrangement and a rectangular arrangement and wherein the second magnet arrangement is arranged such that a radial spacing is provided between the first magnet arrangement positioned inside the second magnet arrangement and the second magnet arrangement.

26. Arrangement according to claim 1, wherein there is provided a guidance device for guiding the control element along the displacement direction, wherein the guiding device is adapted to operate exclusively in non-contacting manner with respect to the control element.

27. Arrangement according to claim 26, wherein the guidance device is formed by the holding device.

28. Arrangement according to claim 1, wherein the electrically controllable appliance is an electric cooker.

29. Arrangement for controlling an electrically controllable appliance, the arrangement comprising:

at least one control element adapted for arrangement on an outside of a plate of said appliance;

a holding device associated with said control element for holding said control element on said plate; and a sensor device adapted for cooperation with a control device of said appliance, said sensor device being adapted to determine at least one of a position and a position change of said control element, wherein at least one of said control elements is constructed as a slider having a rest position and being adapted for automatically returning to said rest position;

wherein said control element is adapted to be displaceable in at least one displacement direction along said plate;

wherein the holding device comprises a first magnet arrangement with a magnetic pole facing the plate and, spaced apart from the first magnet arrangement, a second magnet arrangement comprising opposite polarity;

wherein the second magnet arrangement comprises one of a ring-like arrangement and a rectangular arrangement; and wherein the second magnet arrangement is arranged such that a radial spacing is provided between the first magnet arrangement positioned inside the second magnet arrangement and the second magnet arrangement.

* * * * *